US008471473B2

(12) United States Patent
Fukuyo et al.

(10) Patent No.: US 8,471,473 B2
(45) **Date of Patent: *Jun. 25, 2013**

(54) ARC TUBE FOR DISCHARGE LAMP DEVICE

(75) Inventors: Takeshi Fukuyo, Shizuoka (JP); Akira Homma, Shizuoka (JP); Michio Takagaki, Shizuoka (JP); Shinichi Irisawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 1597 days.

This patent is subject to a terminal disclaimer.

(21) Appl. No.: 11/593,522

(22) Filed: Nov. 7, 2006

(65) Prior Publication Data

US 2007/0103082 A1 May 10, 2007

(30) Foreign Application Priority Data

Nov. 8, 2005 (JP) ..... P.2005-323051

(51) Int. Cl.
*H01J 17/04* (2006.01)

(52) U.S. Cl.
USPC ..... 313/631; 313/633; 313/623

(58) Field of Classification Search
USPC ..... 313/623, 627–643, 567, 111–117, 313/25–27, 318.01–318.09; 439/615, 739; 445/24, 26, 29, 22
See application file for complete search history.

(56) References Cited

U.S. PATENT DOCUMENTS

| | | | | |
|---|---|---|---|---|
| 3,960,421 | A | 6/1976 | Lagues et al. | |
| 5,530,317 | A * | 6/1996 | Willemsen et al. | 313/633 |
| 5,905,340 | A | 5/1999 | Karlotski et al. | |
| 6,190,466 | B1 * | 2/2001 | Apagyi et al. | 148/423 |
| 6,891,332 | B1 | 5/2005 | Irisawa et al. | |
| 2001/0008365 | A1 | 7/2001 | Honda et al. | |
| 2001/0038267 | A1 * | 11/2001 | Ono et al. | 315/106 |
| 2002/0158580 | A1 * | 10/2002 | Uemura et al. | 313/643 |
| 2003/0062839 | A1 | 4/2003 | Takagaki et al. | |

(Continued)

FOREIGN PATENT DOCUMENTS

| | | | |
|---|---|---|---|
| DE | 36340 | A | 4/1965 |
| DE | 56867 | A | 7/1967 |

(Continued)

OTHER PUBLICATIONS

Office Action dated Dec. 27, 2010 from the Japanese Patent Office in Japanese counterpart application No. 2005-323051.

(Continued)

*Primary Examiner* — Donald Raleigh
(74) *Attorney, Agent, or Firm* — Sughrue Mion, PLLC

(57) ABSTRACT

In a mercury free arc tube provided with a sealed glass chamber in which at least metallic halide for main light emission is sealed as well as rare gas by pinch-sealing both end openings of a glass tube and electrode bars are opposite to each other, the tip of a region projecting into the sealed glass chamber of each the electrode bars is formed of a single crystal. Owing to repetition of ON/OFF of the arc tube, the crystal at the tip of the electrode bar grows but the shape of the electrode end face formed of the single crystal remains unchanged. Further, even if the tip of the electrode bar is gradually consumed by thermal load acting on the tip of the electrode bar, the entire shape of the electrode end face is consumed nearly uniformly so that decline of the luminescent spot does not occur during discharging.

9 Claims, 4 Drawing Sheets

U.S. PATENT DOCUMENTS

| | | | | |
|---|---|---|---|---|
| 2004/0036393 | A1 | 2/2004 | Eastlund et al. | |
| 2004/0189208 | A1 * | 9/2004 | Kurimoto et al. | 313/641 |
| 2005/0007022 | A1 * | 1/2005 | Nishida | 313/639 |
| 2005/0134179 | A1 | 6/2005 | Takagaki et al. | |
| 2005/0179391 | A1 * | 8/2005 | Ishigami et al. | 313/637 |
| 2006/0049761 | A1 * | 3/2006 | Almanstotter et al. | 313/631 |

FOREIGN PATENT DOCUMENTS

| | | | |
|---|---|---|---|
| DE | 10030808 | A1 | 1/2001 |
| DE | 102 45 000 | A1 | 4/2003 |
| DE | 102004061302 | A1 | 7/2005 |
| JP | 09-111388 | A | 4/1997 |
| JP | 09-165641 | A | 6/1997 |
| JP | 2001-015067 | A | 1/2001 |
| JP | 2003-338263 | A | 11/2003 |
| JP | 2004-220880 | A | 8/2004 |
| JP | 2005-015917 | A | 1/2005 |
| JP | 2005/123144 | A | 5/2005 |
| JP | 2005-142072 | A | 6/2005 |
| JP | 2005-183164 | A | 7/2005 |
| JP | 2006079998 | A * | 3/2006 |

OTHER PUBLICATIONS

German Office Action dated Mar. 1, 2011 issued in a counterpart application No. 102006052715.1.

German Office Action, dated Apr. 28, 2011, issued in Application No. 10 2006 052 704.6.

* cited by examiner

K-DOPED ELECTRODE

HIGH-PURITY ELECTRODE

THORI-TUN ELECTRODE

MECHANISM OF FLICKER OCCURRENCE

ARC TUBE FOR DISCHARGE LAMP DEVICE

CROSS-REFERENCE TO RELATED APPLICATIONS

This application claims priority from Japanese Patent Application No. 2005-323051, filed Nov. 8, 2005, in the Japanese Patent Office, the entire disclosure of which is incorporated herein by reference.

BACKGROUND OF THE INVENTION

1. Field of the Invention

This invention relates to a mercury free arc tube for a discharge lamp provided with a sealed glass chamber which is filled with at least a metallic halide for main light emission as well as a rare gas by pinch-sealing both end openings of a glass tube and electrode bars are opposite to each other. This invention particularly relates to a mercury free arc tube for a discharge lamp provided with electrode bars each having such a concentric stepped shape that the cross sectional area of a tip side region projecting into the sealed glass chamber is larger than that of a base side region provided in a pinch-sealed portion.

2. Description of the Background Art

FIG. 4 illustrates a related art discharge lamp device. The front end of an arc tube 5 made of quartz glass is supported by a single lead support 2 which projects forward from an insulating base 1. The rear end of the arc tube 5 is supported by a concave portion 1*a* of the insulating base 1. The area adjacent to the rear end of the arc tube 5 is held by a metallic supporting member 4 secured to the front face of the insulating base 1. The lead wire 8 on the front end side led out from the arc tube 5 is fixed to the lead support 2 by welding. On the other hand, the lead wire 8 on the rear end side passes through a bottom wall 1*b* on which the concave portion 1*a* of the base 1 is formed and fixed to a terminal 3 formed on the bottom wall 1*b* by welding. Symbol G denotes a cylindrical glass globe for cutting off a component of ultraviolet rays which have a wavelength which is harmful to the human body and which are emitted from the arc tube 5. The globe G is integral with to the arc tube 5.

The arc tube 5 has a structure in which between a pair of front and rear pinch-sealed portions 5*b*, 5*b*, a sealed glass chamber 5*a* is formed in which electrode bars 6, 6 are opposite to each other and a light emitting material (halide of Na or Sc and Hg) is sealed with rare gas. Within each of the pinch-sealed portions 5*b*, a molybdenum foil 7 is deposited for connecting the electrode bar 6 projecting into the sealed glass chamber 5*a* and the lead wire 8 led out from the pinch-sealed portion 5*b*, thereby assuring hermeticity of the pinch-sealed portions 5*b*.

The mercury (Hg) filled in the sealed glass chamber 5*a* is a very useful substance to keep a predetermined tube voltage and to reduce the quantity of collisions of electrons with the electrode to thereby alleviate damage of the electrode. However, since Hg is harmful to environment, in recent years, development of a "mercury free arc tube" in which Hg is not contained has been advanced.

In the case of a "mercury free" arc tube, the tube voltage is lowered so that the tube power necessary for discharging cannot be obtained. So, in order to increase the tube electric power, it is necessary to increase the current (tube current) to be supplied to the arc tube. The electrode tip correspondingly reaches a high temperature.

Thus, if ON/OFF of the arc tube is repeated, the crystal in the vicinity of the electrode tip will grow (crystal size will expand) so that the shape of the electrode end face changes owing to shifting of a crystal interface position. Thus, the "decline" of the luminescent spot such as displacement of the luminescent spot (the luminescent spot of discharging shifts whenever the arc tube is turned ON/OFF) or shift of the luminescent spot (the luminescent spot shifts while the arc tube is stably kept "ON") occurs. This makes it difficult to acquire appropriate distributed light and to reduce the central brightness of a vehicle-use head lamp.

In order to obviate such inconvenience, in related art patent reference JP-A-2004-220880, as the longitudinal cross sectional structure of the tip side region projecting into the sealed glass chamber of the tungsten electrode bar 6 of the mercury free arc tube, proposed is the structure in which the number of crystals residing in a region 6*a* extending from the tip of the electrode tip to the distance equal to the diameter d of an axial portion is 5 or less and the number of crystals residing in the remaining tip side region 6*b* is 10 or more, as shown in FIG. 5.

In this configuration, since there is less grain boundary at the electrode tip, there is less changes in the shape of the electrode end face resulting from that the crystal interface position changes owing to crystal growth. So, there is less decline of the luminescent spot during discharging. As a result, there is less change in the distributed light and less reduction in the central brightness in a vehicle-use head lamp.

However, in the JP-A-2004-220880 reference, the longitudinal cross sectional structure of the tip projecting into the sealed glass chamber of the tungsten electrode bar is constructed of five or less crystals (e.g. FIG. 5 illustrates a total of three connected crystals consisting of a large crystal C2 at the center and crystals C1 and C3 on the upper and lower sides). In this way, as long as the cross sectional structure of the tip of the electrode bar is constructed of a plurality of crystals, the decline of the luminescent spot during discharging cannot be surely avoided.

Specifically, where ON/OFF of the arc tube is repeated, the crystals C1, C2, C3 grow (their crystal size expands) so that the crystal interface positions P1, P2 shift. As a result, the shape of the electrode tip changes, thereby leading to the decline of the luminescent spot. Namely, the problem of a change in the distributed light and reduction in the central brightness in a vehicle-use head lamp is not solved.

SUMMARY OF THE INVENTION

In view of the above fact, the inventors of this invention have supposed as follows. If the longitudinal cross sectional structure of the tip of the electrode bar projecting into the sealed glass chamber of the mercury free arc tube for the discharge lamp device is formed of a single crystal structure (tip of the electrode bar is formed of a single crystal), the crystal interface is not exposed to the electrode end face. So, even if the crystal grows (crystal size expands) by the repetition of ON/OFF of the arc tube, the crystal interface position does not shift. As a result, the shape of the electrode end face is not changed.

For the configuration in which the longitudinal cross sectional crystal structure of the tip of the electrode bar is formed of the single crystalline structure, experiments and considerations were repeated. As a result, it was confirmed that this configuration is effective to solve the problem of change in the distributed light and reduction of the central brightness in a vehicle-use head lamp. On the basis of this confirmation, this application has been filed.

This invention has been accomplished on the basis of the problem of the prior art described above and the inventor's knowledge. An object of this invention is to provide a mercury free arc tube for a discharge lamp device in which the tip of each said electrodes is formed of a single crystal structure so that decline of a luminescent spot does not occur during discharging even when ON/OFF of the arc tube is repeated.

A first aspect of the invention provides a mercury free arc tube for a discharge lamp provided with a sealed glass chamber in which at a least metallic halide for main light emission as well as a rare gas by pinch-sealing both end openings of a glass tube and electrode bars of tungsten are opposite to each other, wherein the longitudinal cross section crystalline structure of the tip of a region projecting into the sealed glass chamber of each the electrode bars is formed of a single crystal structure.

Concrete examples of the configuration in which the longitudinal cross section crystalline structure of the tip of a region projecting into the sealed glass chamber of each the electrode bars is formed of a single crystal structure include the cases where the electrode bar is formed of a potassium-doped tungsten electrode bar and the electrode bar is formed of a high-purity electrode bar.

Operation

In a mercury free arc tube, in order to compensate for the defect that mercury is not sealed in the sealed glass chamber, the sealing pressure of inner gas (e.g. Xe) is set at 10 to 15 atm, higher than in the case of the mercury-sealed arc tube (usually, 5 to 8 atm.). In order to acquire the tube electric power necessary for discharge, the turn-on power is set at 70 to 85 W, higher than in the case of the mercury-sealed arc tube (usually, 60 to 70 W). Further, the current (tube current) to be supplied to the arc tube is set at 2.7 to 3.2 A, higher than in the case of the mercury-sealed arc tube (usually, 2.2 to 2.6 A). Therefore, the temperature of the tip of the electrode bar correspondingly becomes high. Owing to this, if ON/OFF of the arc tube is repeated, the crystals at the tip of the electrode bar exposed to a high temperature grow (their crystal size expands) so that the crystal interface positions may shift. As a result, the shape of the electrode end face may change, thereby leading to the decline of the luminescent spot.

However, in this invention, the longitudinal cross section crystalline structure of the tip of a region projecting into the sealed glass chamber of each the electrode bars is formed of a single crystal already grown (made coarse) so that the electrode bar is correspondingly difficult to be consumed. Further, even if the crystal at the tip of the electrode bar further grows (its crystal size expands) owing to its exposure to a high temperature, the single crystal structure at the tip of the electrode bar (in which the grain boundary (crystal interface) is not exposed to the end face of the electrode bar) does not change so that the shape of the electrode end face (the shape of the end face of the single crystal) does not also change. Thus, the decline of the luminescent spot does not occur during discharging. Further, even if the tip of the electrode bar formed of the single crystal is gradually consumed, the entire end face shape of the electrode (end face shape of the single crystal) is consumed nearly uniformly, and the decline of the luminescent spot does not occur during discharging.

Each of the electrode bars may be formed in a concentric stepped shape in which the tip side region projecting into the sealed glass chamber is thicker than the base side region deposited on a pinch-sealed portion.

The "stepped shape" is not limited to a shape in which a level difference portion between the electrode bar tip side region and the electrode bar base side region is formed in a right-angle shape as illustrated in the exemplary embodiment (see FIG. 3), but includes a tapered shape or slope shape with a level difference being gradually changing.

Operation

In the mercury free arc tube (in the case of "mercury free"), the tube voltage is lowered so that the tube electric power necessary for discharging cannot be obtained. So, in order to increase the tube electric power, it is necessary to increase the current (tube current) to be supplied to the arc tube. The thermal load to the electrode is correspondingly increased so that the electrode is likely to be consumed (injured). However, by making the region projecting into the sealed glass chamber of the electrode bar (tip side region) thicker than the electrode bar corresponding to the mercury-contained arc tube (by increasing the thermal capacity of the electrode), it is possible to avoid that the temperature of the tip of the electrode bar becomes excessively high, thereby suppressing consumption (injury) of the electrode. On the other hand, if the region deposited on the pinch-sealed portion of the electrode bar (base side region) is also thick like the tip side region, a difference in the quantity of thermal expansion between the electrode bar in the pinch-sealed portion and the glass layer is large. So, owing to the thermal stress generated by repetition of ON/OFF of the arc tube, the longitudinal crack (crack radially extending) leading to leakage of the sealed substance is likely to occur in the pinch-sealed portion. For this reason, it is desirable that the region deposited on the pinch-sealed portion of the electrode bar (base side region) is thinner than the electrode bar tip side region. Namely, by forming the electrode bar in a concentric stepped shape in which the electrode bar tip side region projecting into the sealed glass chamber is thicker than the base side region deposited on the pinch-sealed portion, both consumption (injury) of the electrode and occurrence of the longitudinal crack can be suppressed.

The longitudinal cross sectional crystal structure of the area other than the tip formed of a single crystal in the electrode bar tip side region projecting into the sealed glass chamber may be constructed of a non-sagging crystal structure having a plurality (e.g. ten or more) of stacked slender crystals extending along an axial direction, and the longitudinal cross sectional crystal structure of the electrode bar base side region deposited on the pinch-sealed portion is constructed of a textile crystal structure.

A concrete example of the above configuration in which the tip in the electrode bar tip side region projecting into the sealed glass chamber is constructed of a longitudinal cross sectional single crystal structure and the area other than the tip in the electrode bar tip side region is constructed of a non-sagging crystal structure, and the electrode bar base side region deposited on the pinch-sealed portion is constructed of a textile crystal structure can be realized in a case where the electrode bar is formed of a potassium-doped tungsten electrode bar.

Operation

The electrode bar tip side region exhibits a longitudinal cross sectional crystal structure in which a plurality (ten or more) of slender crystals extending along the axial direction are stacked (non-sagging crystal structure in which a plurality of slender crystals extending along the axial direction are combined so as to be bundled), and so is naturally excellent in strength against the load acting in the axial direction and also against the load acting in a transversal direction. Particularly, even if vertical vibration is conducted to the electrode bar tip side region, the electrode bar will not break. Further, the electrode bar base side region exhibits the longitudinal cross sectional textile crystal structure and so is excellent in strength so that it is difficult to break.

Each of the electrode bars may be formed of a potassium-doped tungsten electrode bar previously vacuum heat-treated within a region of 1200° C. to 2000° C., and which is subjected to aging processing of repeating ON/OFF of the arc tube after the arc tube has been completed.

Operation

Each the electrode bars oppositely provided within the sealed glass chamber in related art is formed of an electrode bar made of thoriated tungsten (generally referred to as "thori-tun"). So, owing to the thoria ($ThO_2$) contained in the tungsten, flicker (arc flicker) is likely to occur. FIG. 6 is a view indicating the mechanism (chemical reaction) of flicker occurrence in a thoriated tungsten electrode bar. In this chemical reaction, it is supposed that owing to deformation of the electrode and vanishing of thoria, a re-ignition voltage rises so that flicker occurs. Further, in order to provide the stepped electrode bar, usually, cutting processing of a pillar-like electrode into a stepped shape is required so that correspondingly, impurities will be deposited on or water will be absorbed by the surface of the electrode bar. So, flicker is more likely to occur.

However, in the potassium-doped tungsten electrode bar, the flicker (arc flicker) will not occur owing to thoria ($ThO_2$). Further, by previously executing the vacuum heat-treatment within a temperature range of 1200° C. to 2000° C. before pinch sealing, the impurities deposited on or the water absorbed in the electrode surface can also be removed. In this case, the longitudinal cross sectional crystalline structure of the entire region of the electrode bar is a textile crystal structure which has an excellent strength and so is difficult to break. Further, in the potassium-doped tungsten electrode bar, which is subjected to an aging processing of repeating ON/OFF after the arc tube has been completed, the longitudinal cross section crystalline structure of the tip side region projecting into the sealed glass chamber of the electrode bar is formed of a non-sagging crystalline structure in which the textile crystals constituting the longitudinal cross sectional textile crystal structure before the aging processing have grown (have been made coarse), as shown in FIG. 3(*a*), and a plurality (ten or more) of crystals extending along the axial direction are stacked. In addition, its tip is formed of a single crystal (single in the longitudinal cross sectional crystal structure) grown (made coarse) so as to be apparently different from the non-sagging crystal.

In accordance with the mercury free arc tube for the discharge lamp device according to this invention, the longitudinal cross sectional crystal structure at the tip in the region projecting into the sealed glass chamber of the electrode bar is formed of a single crystal already grown. For this reason, by repetition of ON/OFF of the arc tube, even when the crystal at the tip of the electrode bar exposed to a high temperature grows or the tip of the electrode is consumed, the tip will be consumed with the shape of the electrode end face formed of the single crystal being kept. Thus, the decline of the luminescent spot during discharging does not occur. Accordingly, the problem in distributed light of change in the distributed light and reduction in the central brightness of a vehicle-use head lamp can be surely solved.

According to one aspect of the invention, since both consumption (injury) of the electrode and occurrence of the longitudinal crack leading to the leakage of the filled substance in the pinch-sealed portion can be suppressed, the mercury free arc tube for the discharge lamp device having a long life can be provided.

According to another aspect of the invention, even if vertical vibration is conducted to the electrode bar, the electrode bar will not break. Because of such endurance of the electrode bar, the long life of the arc tube is assured.

According to another aspect of the invention, by subjecting the potassium-doped tungsten electrode bar to predetermined processing, there is provided a mercury free arc tube for a discharge lamp provided with the electrode which does not generate decline of the luminescent spot during discharging, gives excellent endurance and is difficult to generate flicker.

BRIEF DESCRIPTION OF THE DRAWINGS

FIG. 3(*a*) shows the case where the electrode bar is formed of a potassium-doped tungsten electrode bar, FIG. 3(*b*) shows the case where the electrode bar is formed of a high-purity tungsten electrode bar, and FIG. 3(*c*) shows the case where the electrode bar is formed of a thoriated tungsten electrode bar;

DETAILED DESCRIPTION OF EXEMPLARY EMBODIMENTS OF THE INVENTION

With reference to an exemplary embodiment, an explanation will be given of the mode for carrying out this invention.

Figure 1:
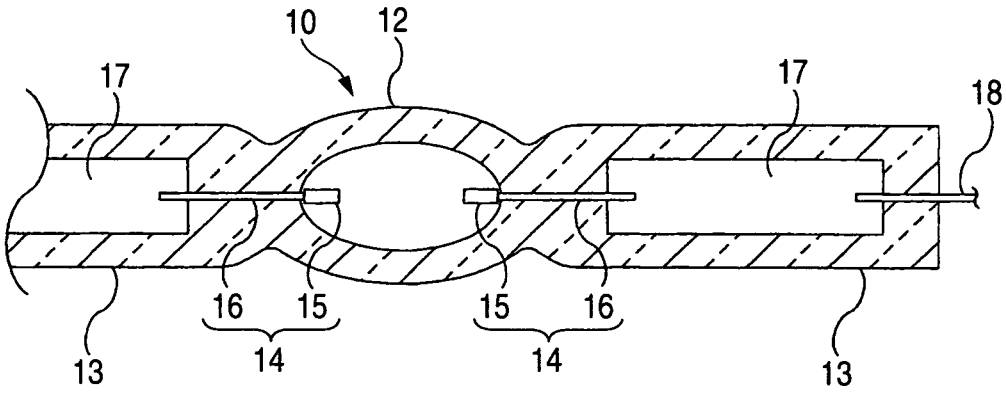
FIG. 1 is a longitudinal cross sectional view of the main part of an arc tube for a discharge lamp device according to a first exemplary embodiment of this invention.
Figure 2:
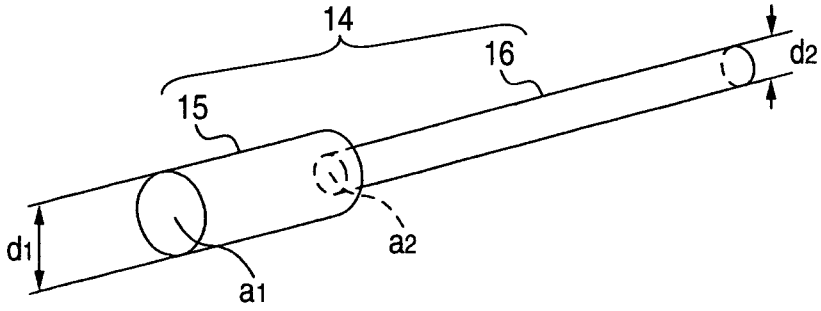
FIG. 2 is an enlarged side perspective view of an electrode bar of the arc tube of FIG. 1.
Figure 3:
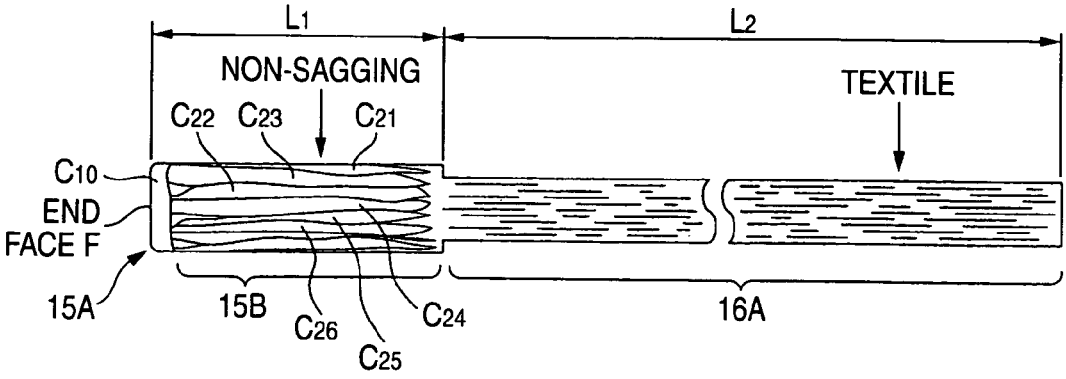
FIGS. 3(*a*) to 3(*c*) are views showing the enlarged longitudinal cross sectional crystalline structure of the tungsten electrode bar previously vacuum heat-treated, when it is subjected to aging processing of repeating ON/OFF of the arc tube after the arc tube for the discharge lamp device has been completed.
Figure 3:
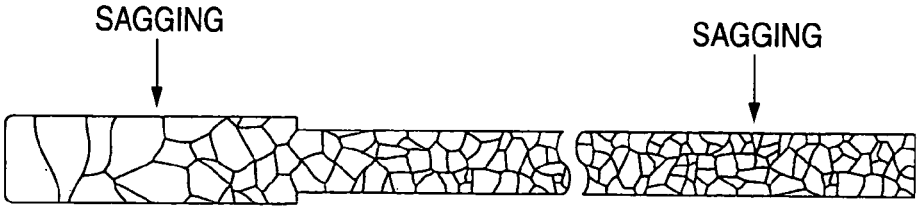
Figure 3:
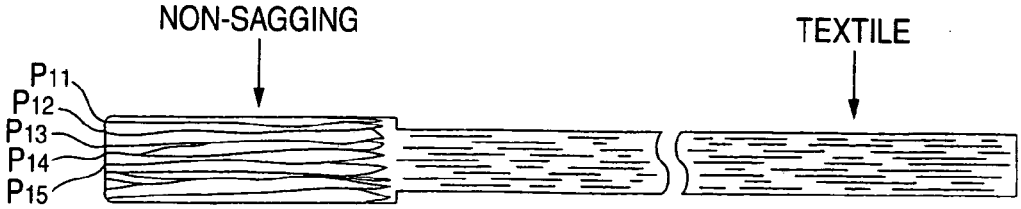

FIGS. 1 to 3 show the first embodiment of this invention. FIG. 1 is a longitudinal cross sectional view of an arc tube for the discharge lamp device according to a first embodiment of this invention. FIG. 2 is an enlarged side perspective view of an electrode bar of the arc tube of FIG. 1. FIGS. 3(*a*) to 3(*c*) are views showing the enlarged longitudinal cross sectional crystalline structure of the tungsten electrode bar previously vacuum heat-treated, when it subjected to aging processing of repeating ON/OFF of the arc tube after the arc tube for the discharge lamp device has been completed; (a) shows the case where the electrode bar is formed of a potassium-doped tungsten electrode bar, (b) shows the case where the electrode bar is formed of a high-purity tungsten electrode bar, and (c) shows the case where the electrode bar is formed of a thoriated tungsten electrode bar.

Figure 4:
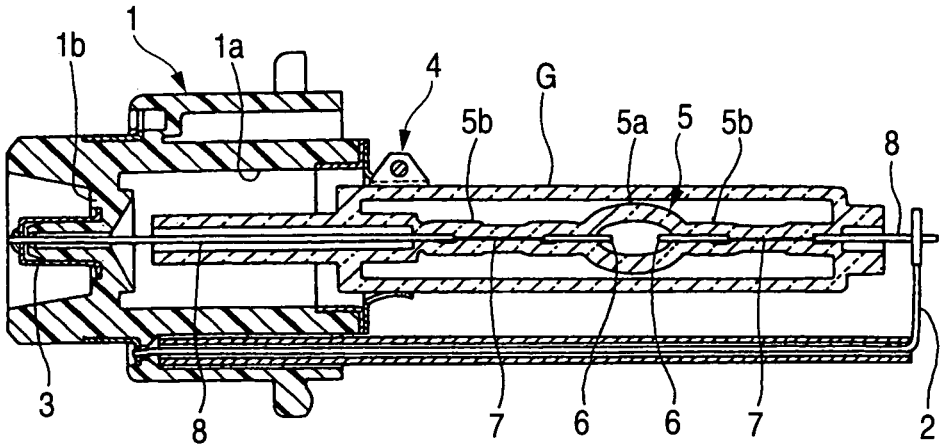
FIG. 4 is a longitudinal cross sectional view of a related art discharge lamp device.
Figure 5:
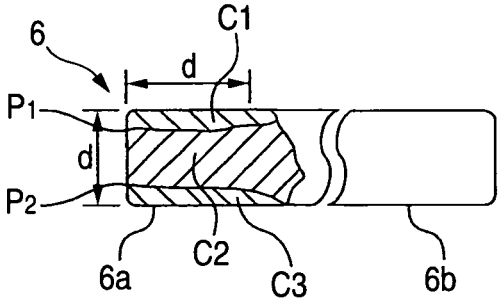
FIG. 5 is a view showing the longitudinal cross sectional crystal structure of a electrode bar tip area in JP-A-2004-220880.

In these figures, the discharge lamp device is provided with an arc tube 10 having substantially the same structure as that of the related art discharge lamp as shown in FIG. 4, except that it employs a mercury free arc tube operating at a rated power of 70 to 85 W (e.g. 75 W).

The arc tube 10 has a very compact structure in which in the longitudinal direction of a linearly extending portion of a circular-pipe shaped quartz glass tube, a spherical swelling portion is formed, and the vicinities of the spherical swelling portion are pinch-sealed to form pinch-sealed portions 13, 13 each having a square shape in cross section at both ends of an elliptical or cylindrical tip-less sealed glass chamber 12 which makes a discharge space having an internal volume of 50 μl or less. The sealed glass chamber 12 is filled with a light emissive material (NaI, $ScI_3$) and a buffering metallic halide such as $ZnI_2$ or $ThI_4$ in lieu of Hg as well as rare gas for actuation (e.g. Xe gas).

Further, within the sealed glass chamber 12, tungsten electrode balls 14, 14 constituting discharge electrodes are oppositely arranged. Each the electrode bars 14, 14 is connected to a molybdenum foil 17 deposited on the pinch-sealed portion 13. From the end of the pinch-sealed portion 13, 13, a molybdenum lead wire 18, 18 connected to the molybdenum foil 17, 17 is led out.

Like the electrode employed in the mercury free arc tube disclosed in related art Patent Reference JP-A-2005-183164, in the arc tube 10 according to this embodiment, the electrode bar 14 is composed of a pillar-like tip side region 15 projecting into the sealed glass chamber 12 and having an outer diameter d1 and a pillar-like base side region 16 deposited on the pinch-sealed portion 13 and having an outer diameter d2 (<d1), which constitute a stepped pillar continued concentrically. Further, the ratio a1/a2 of the cross sectional area a1 of the tip side region 15 to the cross sectional area a2 of the base side region 16 deposited on the pinch-sealed portion 13 is within a range of 1.1 to 7.3.

More specifically, as the outer diameter d1 is large, the electrode bar tip side region 15 projecting into the sealed glass chamber 12 has a larger thermal capacity and so suffers from less consumption (injury) such as consumption or blackening of the electrode. For this reason, the outer diameter d1 is desirably as large as possible (e.g. 0.3 to 0.4 mm) within a range not exceeding the upper limit 0.4 mm of the outer diameter standard for the pillar-like electrode for the same kind of arc tube. Incidentally, if the outer diameter d1 is too large, the thermal capacity of the electrode is also too large so that consumption of thermal energy at the electrode tip will increase and consumption of optical energy, i.e. energy efficiency will be deteriorated. However, this is not problematic as long as the outer diameter d1 does not exceed the upper limit 0.4 mm of the outer diameter standard for the tungsten electrode of the arc tube.

On the other hand, the outer diameter d2 of the electrode bar base side region 16 deposited on the pinch-sealed portion 13 is desirably so small (e.g. 0.1 to 0.3 mm) that the thermal stress generated in the quartz glass layer of the pinch-sealed portion 13 when the arc tube is turned on/off is small.

Specifically, in order to compensate for the sealed glass chamber 12 not being filled with mercury, in the mercury free arc tube 10, the filling pressure of rare gas (e.g. Xe) is set at 10 to 15 atm, higher than in the mercury-filled arc tube (generally 5 to 8 atm); the actuating voltage for acquiring the tube electric power necessary to discharging is set at 75 to 85 W, higher than in the mercury-filled arc tube (generally, 60 to 70 W); and the current (tube current) supplied to the arc tube 10 is set at 2.7 to 3.2 A, higher than in the mercury-filled arc tube (generally, 2.2 to 2.6 A). As a result, since the thermal load acting on the electrode increases and the electrode is likely to be injured, the total volume (capacity) of the electrode 14 is set at 0.4 to 0.6 $mm^3$, larger than in the mercury-filled arc tube (generally, 0.25 to 0.35 $mm^3$). Further, the electrode bar tip side region 15 which may be injured, since it has the larger diameter, is correspondingly resistant to injury. On the other hand, if the electrode bar base side region 16 deposited on the pinch-sealed portion 13 has the larger diameter, the longitudinal crack leading to leakage of the filled substance is likely to occur in the pinch-sealed portion 13 owing to the thermal stress generated when the arc tube is tuned on/off. However, since the diameter of the electrode bar base side region 16 is smaller than that of the electrode bar tip side region 15, the longitudinal crack is correspondingly suppressed in the pinch-sealed portion 13.

As described above, in this exemplary embodiment, the injury of the electrode bar 14 and occurrence of the longitudinal crack in the pinch-sealed portion 13 can be suppressed to a degree in a structure having a stepped-shape in which the diameter of the tip side region 15 projecting into the sealed glass chamber 12 is larger than that of the base side region 16 sealed to the pinch-sealed portion 13.

Figure 6:
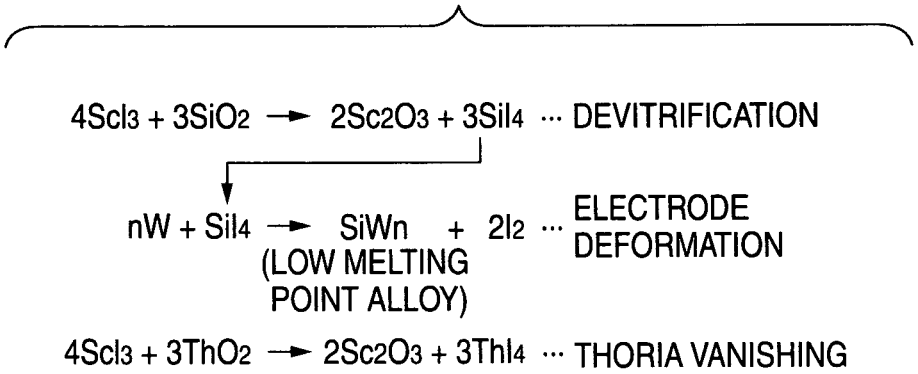
FIG. 6 is a view indicating the mechanism (chemical reaction) of flicker occurrence in the arc tube equipped with an electrode formed of a thoriated tungsten electrode bar.

Further, where the electrode bar 14 is formed of a thoriated tungsten electrode bar which has been widely adopted as opposite electrodes for this kind of mercury free arc tube, owing to the thoria ($ThO_2$) contained in the tungsten, flicker (arc flicker) is likely to occur (see FIG. 6). Further, if ON/OFF of the arc tube 10 is repeated, the textile crystals in the electrode bar tip side region 15 exposed to a high temperature grow (crystal size expand), to thereby provide a longitudinal cross sectional non-sagging crystal structure in which a plurality of crystals each expanded in a slender shape extending along the axial direction are stacked vertically, as shown in FIG. 3(*c*). Therefore, the crystal interface positions P11, P12, P13, P14 and P15 shift on the end face of the electrode bar where a large number of grain boundaries are exposed so that the shape of the end face of the electrode changes. Thus, the decline of the luminescent spot occurs, which gives rise to a problem of impossibility of acquiring appropriate distributed light and reduction of central brightness of a vehicle-use head lamp.

However, in this embodiment, the electrode bar 14 is formed of a potassium-doped tungsten electrode bar so that flicker is difficult to occur. In addition, as seen from FIG. 3(*a*), the longitudinal cross sectional crystal structure 15A at the tip of the electrode bar projecting into the sealed ball 12 is formed of a single crystal C10 already grown (made coarse) so that the electrode bar 14 is correspondingly resistant to being consumed. Further, even if the crystal at the tip of the electrode bar further grows (crystal size expands) owing to exposure to a high temperature, the single crystal structure at the tip of the electrode bar (in which no grain boundary (interface) exists at the tip of the electrode bar) does not change so that the shape of the electrode end face F (the shape of end face of the single crystal C10) does not change. Further, even if the tip of the electrode bar formed of the single crystal C10 is gradually consumed owing to large thermal load acting on the tip of the electrode bar, the shape of the electrode end face F (shape of the end face of the single crystal C10) is consumed nearly uniformly so that the decline of the luminescent spot during discharging does not occur.

Further, in the electrode bar tip side region 15 projecting into the sealed glass chamber 12, as seen from FIG. 3(*a*), the longitudinal cross sectional crystal structure of the area other than the tip formed of the single crystal C10 is constructed of a non-sagging crystal structure 15B in which a plurality of slender crystals extending along an axial direction are stacked (the crystals C21, C22, C23, C24, C25 and C26 . . . each expanded in a slender shape so as to extended in the axial direction are combined in a format bundled in a ring shape, and so is naturally excellent in strength against the load acting in the axial direction and also against the load acting in a transversal direction. Particularly, even if vertical vibration is conducted to the electrode bar 14, it will not break.

Further, as seen from FIG. 3(*a*), the longitudinal cross sectional crystal structure of the electrode bar base side region 16 deposited on the pinch-sealed portion 13 is formed of a textile crystal structure 16A which is excellent in strength so that it is difficult to break.

Additionally, the electrode bar is manufactured while a wire formed from ingot of sintered powder material is extended using a dice (by wire drawing) so that the crystal constituting the electrode bar is extended to be textile. The electrode bar thus manufactured still contains distortion (compressive distortion), and when heat is applied to the electrode bar, the crystals tend to become round and large to release the distortion. Therefore, in the potassium-doped tungsten electrode bar containing a dopant or thoriated-tungsten electrode bar, if the temperature of the electrode tip becomes high owing to repetition of ON/OFF of the arc tube, the crystals tend to become round and large. This tendency, however, is restricted to a degree owing to the presence of the dopant. As a result, the crystals becomes coarse while changing in non-sagging shape. Particularly, in the potassium-doped tungsten electrode bar, it is presumed that the dopant (potassium) contained in the crystals at the electrode tip is scattered to provide a large single crystal C10 (see FIGS. 3(*a*), (*c*)). On the other hand, in the high-purity tungsten electrode bar containing no dopant, the tendency of the crystals becoming round and large is not restricted. Thus, the crystals over the entire region of the electrode are made coarse in a sagging shape by vacuum heat treatment. Further, as the temperature of the electrode tip becomes high owing to repetition of ON/OFF of the arc tube, the crystals gradually are made coarse at the electrode tip (see FIG. 3(*b*).

Next, an explanation will be given of a method for forming the potassium-doped tungsten stepped electrode bar 14 in the longitudinal cross sectional crystal structure (15A, 15B, 16A) as described above.

First, the potassium-doped tungsten stepped electrode bar 14 is previously subjected to the vacuum heat treatment within a range of 1200° C. to 2000° C. (desirably 1600° C.). By the vacuum heat treatment for the electrode bar 14, water deposited on the surface of the electrode bar 14 and impurities adsorbed in the electrode bar 14 are removed. At this time, the longitudinal cross sectional crystal structure over the entire region of the electrode bar 14 still has the textile crystal structure (reference symbol 16A) which is excellent in strength and so difficult to break. Next, an electrode assembly ("assy") is prepared by integrally connecting the base side of the electrode bar 14 as well as a lead wire 18 to a molybdenum foil 17. Further, by a conventionally known technique not shown, both end openings of a glass tube through which the electrode "assy"s are passed are pinch-sealed at the positions each including the molybdenum foil so that the sealed glass chamber is filled with NaI or $ScI_3$ serving as a main light emission material and buffering metallic halide such as $ZnI_2$ or $ThI_4$ in lieu of Hg as well as rare gas for actuation (e.g. Xe gas). Thus, the mercury free arc tube 10 provided with a sealed glass chamber 12 in which the electrode bars 14 are opposite is made.

The arc tube 10 is subjected to the aging processing of repetition of its ON/OFF for two hours. In this case, in the electrode bar base side region 16 deposited on the pinch-sealed portion 13, which is not influenced by aging heat, its textile crystal structure 16A remains unchanged. On the other hand, in the electrode bar tip side region 15 projecting into the sealed glass chamber 12, under the influence of the aging heat, individual textile crystals grow to provide a longitudinal cross-sectional non-sagging crystal structure 15B. In addition, at its tip of the electrode bar tip side region 15, a cross-sectional single crystal structure 15A is given which is formed of the single crystal C10 having a diameter nearly equal to that of the electrode bar tip side region 15.

FIGS. 3(*a*) to 3(*c*) show the respective longitudinal cross sectional crystal structures in an experiment using three kinds of tungsten electrode bars of potassium-doped tungsten, high-purity tungsten and thoriated tungsten as the tungsten electrode bar 14 in the mercury free arc tube 10. In this experiment, the entire length L of the electrode bar 14 is set at 6.5 mm; the length L1 of the electrode bar tip side region 15 is set at 1.5 mm; the length L2 of the electrode bar base side region 16 is set at 5.0 mm; the outer diameter d1 of the electrode bar tip side region 15 is set at 0.37 mm; the outer diameter d2 of the electrode bar base side region 16 is set at 0.3 mm. Further, under entirely the same condition, these three kinds of electrode bars are subjected to the vacuum heat treatment and the aging processing of repeating ON/OFF of the arc tube after the arc tube 10 has been completed.

In the potassium-doped tungsten bar shown in FIG. 3(*a*), the electrode tip is formed of the single crystal made coarse, and the crystals C21, C22, C23, C24, C25 and C26 over the entire area (the area extending to 1.5 mm from the electrode tip) of the electrode bar tip side region 15 except the single crystal C10 of the electrode tip are made coarse in non-sagging shapes. These non-sagging crystals appear slightly thicker than those in the thoriated tungsten electrode bar shown in FIG. 3(*c*). The entire area of the electrode bar base side region 16 exhibits the textile crystal structure 16A.

In the high-purity tungsten electrode bar shown in FIG. 3(*b*), the crystals are made coarse in the sagging-shape over the entire area of the electrode bar. Particularly, in the electrode bar base side region 16, the crystals on the side nearer to the step are made coarse.

In the thoriated tungsten electrode bar shown in FIG. 3(*c*), the crystals in the area extending to 1.2 mm from the electrode tip of the electrode bar tip side region 15 are made coarse in non-sagging shapes. The entire area of the electrode bar base side region 16 exhibits the textile crystal structure 16A.

In the thoriated tungsten electrode bar shown in FIG. 3(*c*), the electrode bar tip side region 15 inclusive of its tip exhibits the non-sagging crystal structure. Owing to this, a large number of grain boundaries P11, P12, P13, P14 and P15 leading to the decline of the luminescent spot during discharging are exposed to the end face of the electrode bar. On the other hand, in the potassium-doped tungsten electrode bar shown in FIG. 3(*a*) and in the high-purity tungsten electrode bar shown in FIG. 3(*b*), the electrode tip is formed of the single crystal grown (made coarse) and on the electrode end face, there is no crystal interface (grain boundary) leading to the decline of the luminescent spot during discharging. Thus, in the potassium-doped tungsten electrode bar and the high-purity tungsten bar, the "decline" of the luminescent spot due to the change in the shape of the electrode end face such as displacement of the luminescent spot or shift of the luminescent spot does not occur.

In this way, if attention is paid to the fact that the longitudinal cross sectional crystal structure of the tip of the electrode bar 14 projecting into the sealed glass chamber 12 is formed of the single crystal already grown (made coarse), thereby preventing the decline of the luminescent spot during discharging, the electrode bar 14 may be constructed of the high-purity tungsten electrode bar.

However, the high-purity tungsten electrode bar is expensive as compared with the potassium-doped tungsten electrode bar. In addition, as shown in FIG. 3(*b*), the longitudinal cross sectional crystal structure over the entire area thereof is formed in the sagging shape which is weak in strength as compared with the non-sagging crystal structure or textile crystal structure. Further, the longitudinal cross sectional crystal structure in the electrode bar tip side region is formed in the sagging shape of crystals further grown (made more coarse) so that its endurance is inferior particularly in the electrode bar tip side region. Accordingly, in the mercury free arc tube, the electrode bar 14 formed of the potassium-doped tungsten electrode bar has several advantages.

In the embodiment described above, the electrode bar 14 was formed in a concentric stepped shape in which the tip side region 15 projecting into the sealed glass chamber 12 is thicker than the base side region 16 sealed to the pinch-sealed portion 13. However, the shape of the electrode bar 14 should not be limited to the concentric stepped shape, but may be a shape in which the tip side region 15 and the base side region 16 have a uniform thickness.

While the present invention has been described in connection with exemplary embodiments, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A discharge lamp device, comprising:

an arc tube, including a sealed glass chamber in which at least a metallic halide and a rare gas are sealed by pinch-sealing both end openings of a glass tube; and electrode bars of tungsten provided opposite each other;

wherein the longitudinal cross sectional crystal structure of the tip of a region projecting into the sealed glass chamber of each of the electrode bars is formed of a single crystal structure, wherein the longitudinal cross sectional crystal structure of the area other than the tip formed of the single crystal in the electrode bar tip side region projecting into the sealed glass chamber comprises a non-sagging crystal structure having a plurality of stacked slender crystals extending along an axial direction;

wherein each of said electrode bars comprises an electrode bar mainly composed of a potassium-doped tungsten, the arc tube is installed in the discharge lamp device after the electrode bar has been vacuum heat-treated within a range of 1200° C. to 2000° C., and subjected to aging processing of repeating ON/OFF of the arc tube after the arc tube has been assembled.

2. The discharge lamp device according to claim 1, wherein each of said electrode bars is formed in a shape in which the tip side region projecting into the sealed glass chamber, including the tip of the tip side region, is thicker than the base side region provided in a pinch-sealed portion.

3. The discharge lamp device according to claim 1, wherein the longitudinal cross sectional crystal structure of the electrode bar base side region deposited on the pinch-sealed portion comprises a textile crystal structure.

4. The discharge lamp device according to claim 2, wherein the electrode bars are formed in a concentric stepped shape.

5. A discharge lamp device, comprising:

an arc tube, including a sealed glass chamber; a metallic halide and a rare gas sealed in the sealed glass chamber; and electrode bars provided so that tip portions of the electrode bars oppose one another in the sealed glass chamber;

wherein the ends of the tip portions of the electrode bars comprise a single crystal structure, wherein an area of the tip portions provided in the sealed glass chamber other than the end of the tips formed of the single crystal structure comprises a non-sagging crystal structure having a plurality of stacked slender crystals extending in an axial direction of the electrode bars;

wherein each of the electrode bars comprises an electrode bar mainly composed of a potassium-doped tungsten, the arc tube is installed in the discharge lamp device after the electrode bar potassium-doped tungsten electrode bars have been vacuum heat-treated at a temperature of 1200° C. to 2000° C., and the electrode bars have been subjected to an aging process of repeated on/off of the arc tube.

6. The discharge lamp device according to claim 5, wherein the tip portions of each of the electrode bars provided in the sealed glass chamber, including tips of the tip portions, are thicker than base portions of the electrode bars provided outside of the sealed glass chamber in a pinch-sealed portion.

7. The discharge lamp device according to claim 6, wherein the arc tube is a mercury-free arc tube.

8. The discharge lamp device according to claim 7, wherein the base portions of the electrode bars comprise a textile crystal structure.

9. The discharge lamp device according to claim 1, wherein the metallic halide is for main light emission.

* * * * *